US011602781B2

(12) United States Patent
Agrawal et al.

(10) Patent No.: US 11,602,781 B2
(45) Date of Patent: Mar. 14, 2023

(54) SPHERICAL COIL WINDING MACHINE

(71) Applicant: HONEYWELL INTERNATIONAL INC., Morris Plains, NJ (US)

(72) Inventors: Saurabh Agrawal, Bangalore (IN); Deena Dayalan Kothandaraman, Bangalore (IN); Renju Chandrasekhara Panicker, Bangalore (IN)

(73) Assignee: HONEYWELL INTERNATIONAL INC., Charlotte, NC (US)

( * ) Notice: Subject to any disclaimer, the term of this patent is extended or adjusted under 35 U.S.C. 154(b) by 615 days.

(21) Appl. No.: 16/721,089

(22) Filed: Dec. 19, 2019

(65) Prior Publication Data

US 2020/0222960 A1 Jul. 16, 2020

(30) Foreign Application Priority Data

Jan. 10, 2019 (IN) ..... 201941001269

(51) Int. Cl.
*B21C 47/00* (2006.01)
*B21C 47/04* (2006.01)
(Continued)

(52) U.S. Cl.
CPC ..... *B21C 47/045* (2013.01); *B65H 54/10* (2013.01); *B65H 54/44* (2013.01); *H01F 41/071* (2016.01);
(Continued)

(58) Field of Classification Search
CPC ... B21C 47/075; B21C 47/146; H01F 41/071; H01F 41/088; H01F 41/09; B65H 54/026;
(Continued)

(56) References Cited

U.S. PATENT DOCUMENTS 1,582,777 A * 4/1926 Orswell ..... C12G 1/0209 336/191
2,394,028 A 2/1946 Volsk
(Continued)

FOREIGN PATENT DOCUMENTS

CN 206023409 U * 3/2017
CN 208819724 U * 5/2019 ..... H01F 21/02
(Continued)

*Primary Examiner* — Emmanuel M Marcelo
(74) *Attorney, Agent, or Firm* — Lorenz & Kopf, LLP

(57) ABSTRACT

An apparatus for winding coils onto a spherical body includes a frame, a feeder spool, a first hemispherical bobbin, a second hemispherical bobbin, a first spring-loaded pin, a second spring-loaded pin, and a motor arrangement. The feeder spool is rotationally mounted on the frame, has first and second wires wound thereon, and is configured to rotate about a first rotational axis. The first and second hemispherical bobbins are rotationally mounted on the frame and configured to rotate about a second rotational axis that is parallel to the first rotational axis. The bobbins are spaced apart from each other to define a wire-feeder gap through which the first and second wires may be fed. The motor arrangement is coupled to the first and second hemispherical bobbins and is configured to cause the first and second hemispherical bobbins to rotate in opposite directions about the second rotational axis.

20 Claims, 4 Drawing Sheets

(51) Int. Cl.
*B65H 54/44* (2006.01)
*B65H 54/10* (2006.01)
*H01F 41/071* (2016.01)

(52) U.S. Cl.
CPC ..... *B65H 2403/92* (2013.01); *B65H 2701/36* (2013.01)

(58) Field of Classification Search
CPC ..... B65H 54/10; B65H 54/44; B65H 54/48; B65H 54/50
See application file for complete search history.

(56) References Cited

U.S. PATENT DOCUMENTS

| | | | | | |
|---|---|---|---|---|---|
| 2,455,355 | A | | 12/1948 | Combs | |
| 3,071,331 | A | * | 1/1963 | Holman | B29D 99/0042 156/170 |
| 3,097,535 | A | * | 7/1963 | Bers | G01C 21/18 74/5.6 D |
| 9,893,574 | B2 | | 2/2018 | Bandera | |
| 2010/0019764 | A1 | | 1/2010 | Zahn | |

FOREIGN PATENT DOCUMENTS

| | | | | | |
|---|---|---|---|---|---|
| JP | 2003018811 | A | * | 1/2003 | |
| JP | 2016178149 | A | * | 10/2016 | H01F 27/2847 |
| KR | 20100118381 | A | * | 11/2010 | B65H 54/10 |

* cited by examiner

SPHERICAL COIL WINDING MACHINE

CROSS-REFERENCE TO RELATED APPLICATION

The present application claims benefit of prior filed Indian Provisional Patent Application No. 201941001269, filed Jan. 10, 2019, which is hereby incorporated by reference herein in its entirety.

TECHNICAL FIELD

The present invention generally relates to electromagnetic machines having spherical coils, and more particularly relates to a machine and process that may be used to wind spherical coils.

BACKGROUND

It is generally known that currently available motion control systems that are designed to move an object in more than one degree of freedom (DoF) include a separate motor or actuator for each DoF. More specifically, at least two motors or actuators are needed to implement 2-DoF motion, at least three motors or actuators are needed to implement 3-DoF motion, and so on. Consequently, mechanisms that involve more than one DoF tend to be somewhat large and cumbersome, and therefore inefficient.

While electronics and sensor technologies have gotten significantly smaller in recent years, mechanical motion technology has not kept up. This is why motion systems such as pan/tilt mechanisms are typically not used on smaller platforms, such as mini- or micro-UAVs (unmanned air vehicles) and micro-satellites. Robotics systems, which depend on multi-DoF motion control, must simply put up with the inherent inefficiencies of current motion-on-motion systems.

Various types of multi-axis machines have been developed to address the above-described problems. In many instances, however, these multi-axis machines are manufactured using relatively difficult, time consuming, non-standard, and low-repeatable processes and methods.

Hence, there is a need for an apparatus and method of manufacturing multi-degree of freedom electromechanical machines that is relatively easier, less time consuming, standard, and exhibits high repeatability as compared to known apparatus and methods. The present invention addresses at least these needs.

BRIEF SUMMARY

This summary is provided to describe select concepts in a simplified form that are further described in the Detailed Description. This summary is not intended to identify key or essential features of the claimed subject matter, nor is it intended to be used as an aid in determining the scope of the claimed subject matter.

In one embodiment, an apparatus for winding spherical coils includes a frame, a feeder spool, a first hemispherical bobbin, a second hemispherical bobbin, a first spring-loaded pin, a second spring-loaded pin, and a motor arrangement. The feeder spool is rotationally mounted on the frame and is configured to rotate about a first rotational axis. The feeder spool has a first wire wound thereon and a second wire wound thereon. The first hemispherical bobbin is rotationally mounted on the frame and has a first inner surface and is configured to rotate about a second rotational axis that is parallel to the first rotational axis. The second hemispherical bobbin is rotationally mounted on the frame and has a second inner surface and is configured to rotate about the second rotational axis. The second hemispherical bobbin is spaced apart from the first hemispherical bobbin to define a wire-feeder gap through which the first and second wires may be fed. The first spring-loaded pin is mounted on the first inner surface, and the second spring-loaded pin is mounted on the second inner surface. The motor arrangement is coupled to the first and second hemispherical bobbins. The motor arrangement is configured to cause the first hemispherical bobbin to rotate in a first rotational direction about the second rotational axis, and cause the second hemispherical bobbin to rotate in a second rotational direction about the second rotational axis. The second rotational direction is opposite to the first rotational direction.

In another embodiment, an apparatus for winding spherical coils includes a frame, a feeder spool, a first hemispherical bobbin, a second hemispherical bobbin, a first slit, a second slit, a first spring-loaded pin, a second spring-loaded pin, a spool motor, a motor arrangement, an image sensor, and a control. The feeder spool is rotationally mounted on the frame and is configured to rotate about a first rotational axis. The feeder spool has a first wire wound thereon and a second wire wound thereon. The first hemispherical bobbin is rotationally mounted on the frame and has a first inner surface and is configured to rotate about a second rotational axis that is parallel to the first rotational axis. The second hemispherical bobbin is rotationally mounted on the frame and has a second inner surface and is configured to rotate about the second rotational axis. The second hemispherical bobbin is spaced apart from the first hemispherical bobbin to define a wire-feeder gap through which the first and second wires may be fed. The first slit is formed in, and extends through, the first hemispherical bobbin, and the second slit is formed in, and extends through, the second hemispherical bobbin. The first spring-loaded pin is mounted on the first inner surface, and the second spring-loaded pin is mounted on the second inner surface. The spool motor is coupled to the feeder spool and is operable to regulate a rate at which the first and second wires are being supplied. The motor arrangement is coupled to the first and second hemispherical bobbins. The motor arrangement is configured to cause the first hemispherical bobbin to rotate in a first rotational direction about the second rotational axis, and cause the second hemispherical bobbin to rotate in a second rotational direction about the second rotational axis. The second rotational direction is opposite to the first rotational direction. The image sensor is mounted on the frame and is spaced apart from the first and second hemispherical bobbins. The image sensor is disposed to capture images through the first and second slits and supply feedback signals. The control is in operable communication with the image sensor, the spool motor, and the motor arrangement. The control is coupled to receive the feedback signals from the image sensor and is configured, in response thereto, to control the spool motor and motor arrangement.

In yet another embodiment, an apparatus for winding spherical coils includes a frame, a feeder spool, a first hemispherical bobbin, a second hemispherical bobbin, a first hemispherical body, a second hemispherical body, a first slit, a second slit, a first spring-loaded pin, a second spring-loaded pin, a spool motor, a motor arrangement, an image sensor, and a control. The feeder spool is rotationally mounted on the frame and is configured to rotate about a first rotational axis. The feeder spool has a first wire wound thereon and a second wire wound thereon. The first hemispherical bobbin is rotationally mounted on the frame and has a first inner surface and is configured to rotate about a second rotational axis that is parallel to the first rotational axis. The second hemispherical bobbin is rotationally mounted on the frame and has a second inner surface and is configured to rotate about the second rotational axis. The second hemispherical bobbin is spaced apart from the first hemispherical bobbin to define a wire-feeder gap through which the first and second wires may be fed. The first hemispherical body is disposed within the first hemispherical cavity and is adapted to have the first wire wound thereon. The second hemispherical body is disposed within the second hemispherical cavity and is adapted to have the second wire wound thereon. The first slit is formed in, and extends through, the first hemispherical bobbin, and the second slit is formed in, and extends through, the second hemispherical bobbin. The first spring-loaded pin is mounted on the first inner surface, and the second spring-loaded pin is mounted on the second inner surface. The spool motor is coupled to the feeder spool and is operable to regulate a rate at which the first and second wires are being supplied. The motor arrangement is coupled to the first and second hemispherical bobbins. The motor arrangement is configured to cause the first hemispherical bobbin to rotate in a first rotational direction about the second rotational axis, and cause the second hemispherical bobbin to rotate in a second rotational direction about the second rotational axis. The second rotational direction is opposite to the first rotational direction. The image sensor is mounted on the frame and is spaced apart from the first and second hemispherical bobbins. The image sensor is disposed to capture images through the first and second slits and supply feedback signals. The control is in operable communication with the image sensor, the spool motor, and the motor arrangement. The control is coupled to receive the feedback signals from the image sensor and is configured, in response thereto, to control the spool motor and motor arrangement.

Furthermore, other desirable features and characteristics of the apparatus will become apparent from the subsequent detailed description and the appended claims, taken in conjunction with the accompanying drawings and the preceding background.

BRIEF DESCRIPTION OF THE DRAWINGS

The present invention will hereinafter be described in conjunction with the following drawing figures, wherein like numerals denote like elements, and wherein.

DETAILED DESCRIPTION

The following detailed description is merely exemplary in nature and is not intended to limit the invention or the application and uses of the invention. As used herein, the word "exemplary" means "serving as an example, instance, or illustration." Thus, any embodiment described herein as "exemplary" is not necessarily to be construed as preferred or advantageous over other embodiments. All of the embodiments described herein are exemplary embodiments provided to enable persons skilled in the art to make or use the invention and not to limit the scope of the invention which is defined by the claims. Furthermore, there is no intention to be bound by any expressed or implied theory presented in the preceding technical field, background, brief summary, or the following detailed description.

Figure 1:
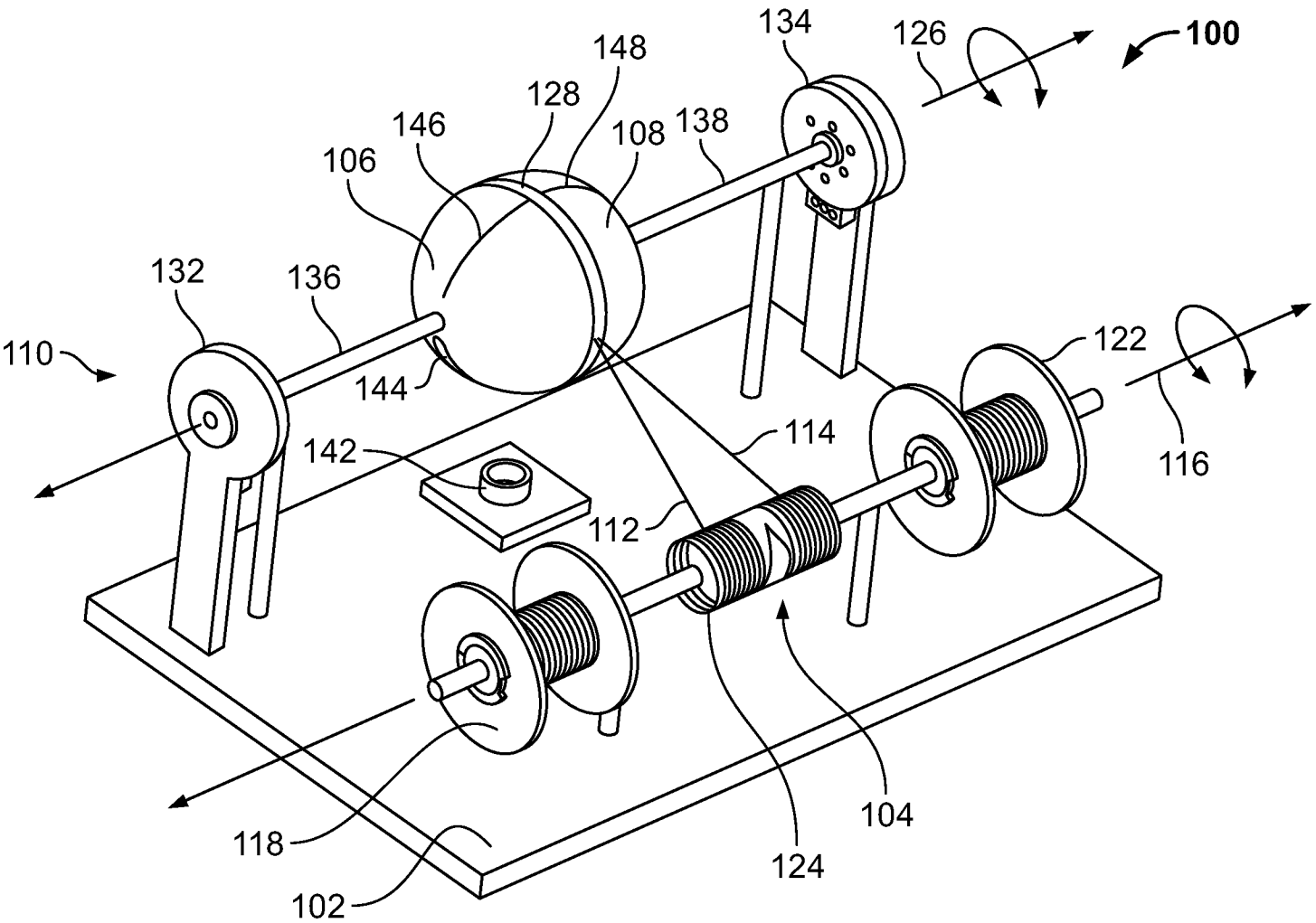
FIG. 1 depicts a plan view of one embodiment of an apparatus for winding spherical coils.

With reference first to FIG. 1, an apparatus 100 for winding coils onto a spherical body is depicted, and includes a frame 102, a feeder spool 104, a first hemispherical bobbin 106, a second hemispherical bobbin 108, and a motor arrangement 110. The frame 102 may be variously shaped and configured, and it may be constructed of any one of numerous materials. As will be described, the frame 102 is used to support many of the other components that are used to implement the apparatus 100.

The feeder spool 104 is rotationally mounted on the frame 102 and has a first wire 112 and a second wire 114 wound thereon and is configured to rotate about a first rotational axis 116. In the depicted embodiment, the first wire 112 is fed to the feeder spool 104 from a first supply spool 118 that is also rotationally mounted on the frame 102, and the second wire 114 is fed to the feeder spool 104 from a second supply spool 122 that is rotationally mounted on the frame 102. It will be appreciated that the first wire 112 and second wire 114 are preferably identical types of wire and that each wire 112, 114 is preferably equal in length.

The feeder spool 104, at least in the depicted embodiment, is coupled to, or mounted on, a spool motor 124. The spool motor 124, if included, may be implemented using any one of numerous types of AC or DC motors, and is controlled to regulate, if needed, the rate at which the first and second wires 112, 114 are being supplied. The spool motor 124 may also be used to remove, partially or fully, the first and second wires 112, 114 if an error occurs during the winding process.

The first hemispherical bobbin 106 is rotationally mounted on the frame 102 and is configured to rotate about a second rotational axis 126. As FIG. 1 depicts, the second rotational axis 126 is spaced apart from, and is parallel to, the first rotational axis 116. The second hemispherical bobbin 108 is rotationally mounted on the frame 102 and is also configured to rotate about the second rotational axis 126. The first and second hemispherical bobbins 106, 108 are spaced apart from each other to define a wire-feeder gap 128. It is through the wire-feeder gap that the first and second wires 112, 114 are fed.

Figure 2:
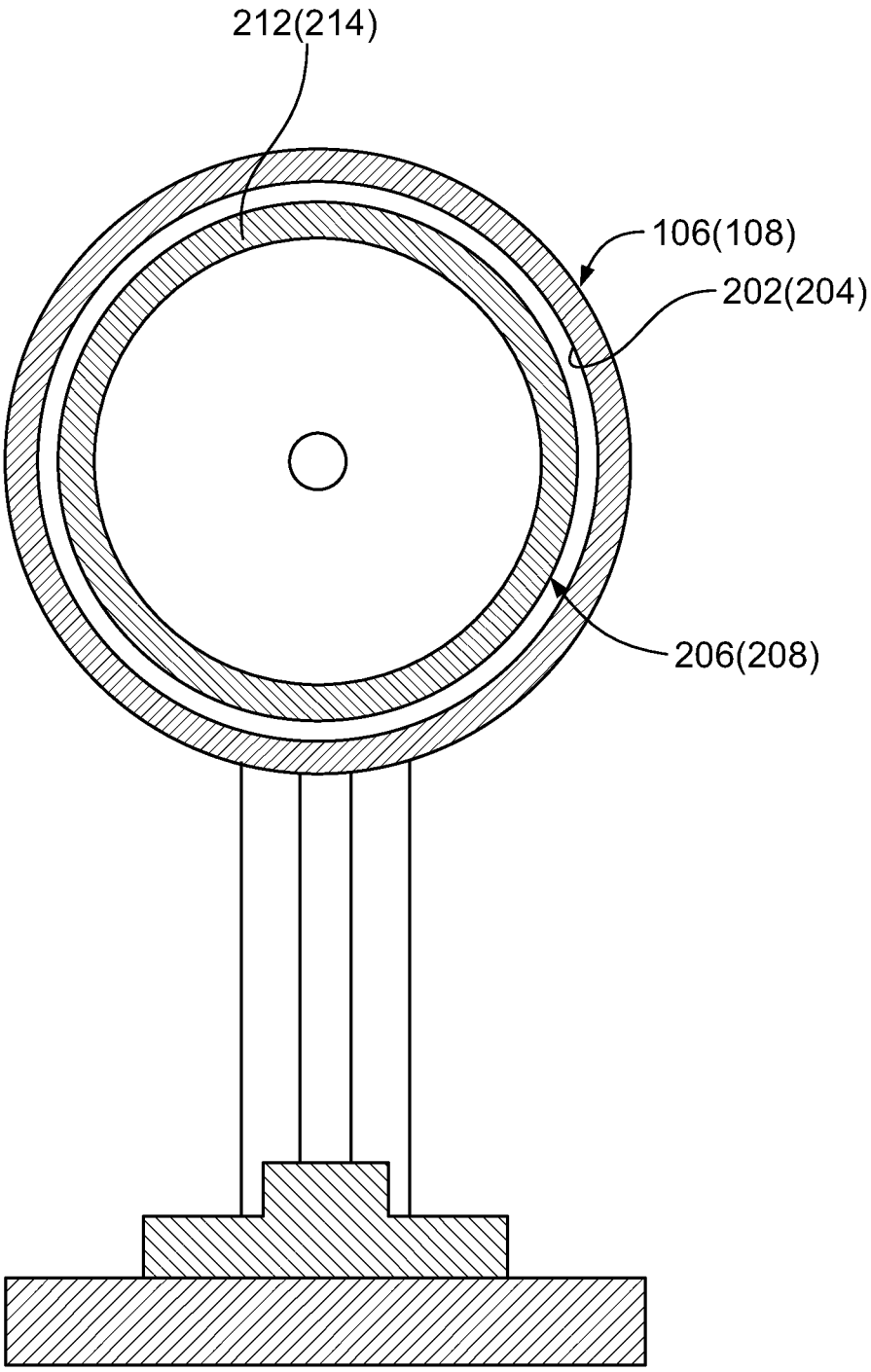
FIG. 2 depicts a cross section view of a portion of the apparatus depicted in FIG. 1.
Figure 3:
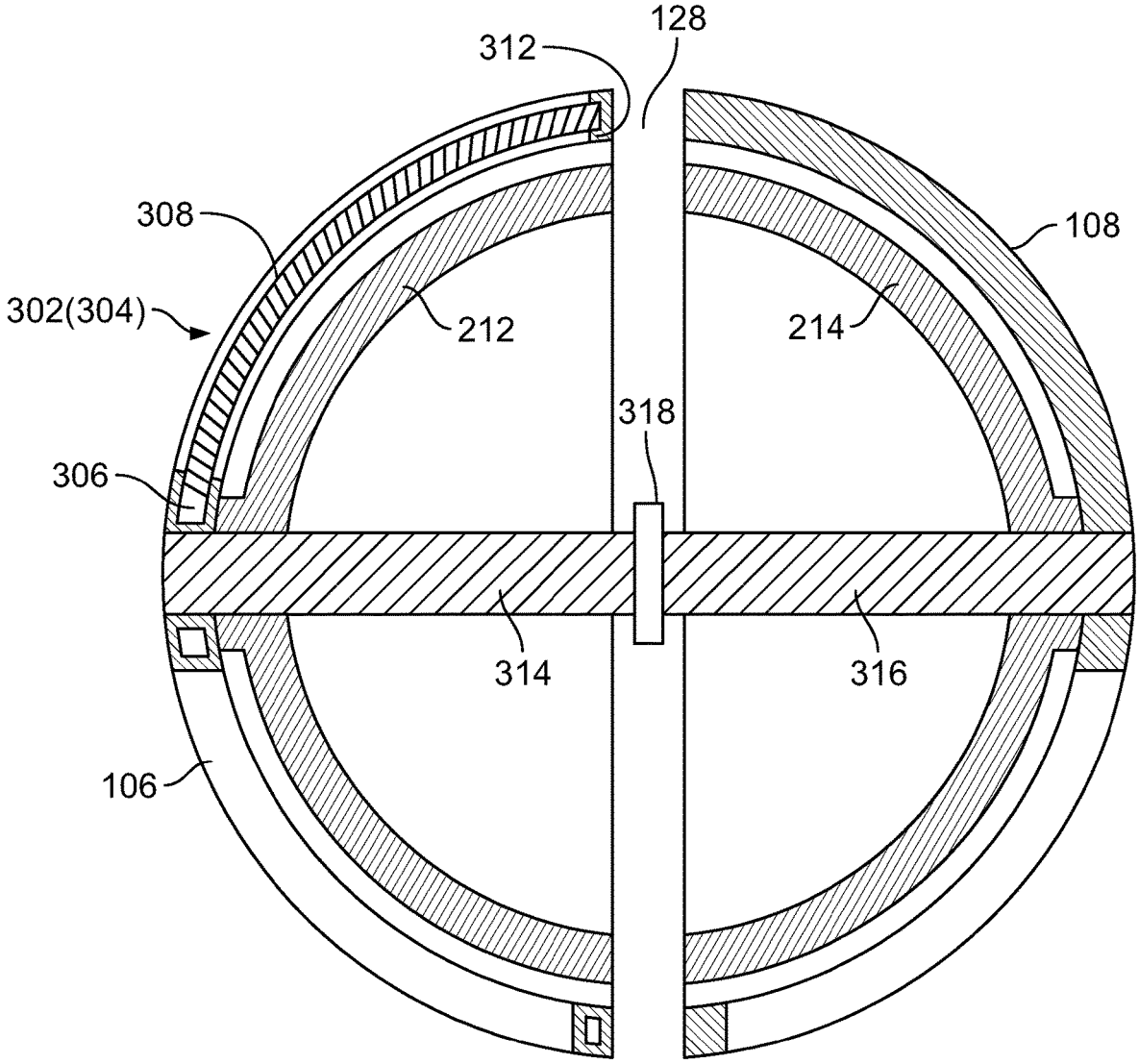
FIG. 3 depicts a close-up partial cross section view of one of the hemispherical bobbins that may be used to implement the apparatus of FIG. 1.

Referring briefly to FIGS. 2 and 3, it may be seen that the first hemispherical bobbin 106 has a first inner surface 202, and the second hemispherical bobbin 108 has a second inner surface 204. As may be appreciated, the first and second inner surfaces 202, 204 define first and second hemispherical cavities 206, 208. A first hemispherical body 212 is disposed within the first hemispherical cavity 206, and a second hemispherical body 214 is disposed within the second hemispherical cavity 208. It is on the first and second hemispherical bodies 212, 214 that the first and second wires 112, 114 are wound.

As shown most clearly in FIG. 3, a first spring-loaded pin 302 is mounted within the first hemispherical bobbin 106, and a second spring-loaded pin 304 is mounted within the second hemispherical bobbin 108. As will be described further below, the first and second spring-loaded pins 302, 304, are used to ensure the first and second wires 112, 114 are tightly and evenly wound on the first and second hemispherical bodies 212, 214, respectively. Although the spring-loaded pins 302, 304 may be variously implemented, in the depicted embodiment, each includes a spring guide 306, a spring 308, and a pin 312. Each spring guide 306 is coupled to its associated hemispherical bobbin 106, 108, and each spring 308 is disposed around its associated spring guide 306. Each pin 312 is coupled to its associated spring 308 and extends partially into a guide slot 146, 148 (see FIG. 1) formed in the first and second hemispherical bobbins 106, 108.

As FIG. 3 also shows more clearly, the first hemispherical bobbin 106 and the first hemispherical body 212 are mounted on a first shaft 314, and the second hemispherical bobbin 108 and the second hemispherical body 214 are mounted on a second shaft 316. The first and second shaft 314, 316 are each coupled, at one of their ends, to a bearing assembly 318 which allows the first and second shafts 314, 316, and thus the first and second hemispherical bobbins 106, 108 and the first and second hemispherical bodies 212, 214 to rotate in opposite directions.

Returning to FIG. 1, the motor arrangement 110 is coupled to the first and second hemispherical bobbins 106, 108. The motor arrangement 110 is configured to cause the first hemispherical bobbin 106 to rotate in a first direction about the second rotational axis 126, and to cause the second hemispherical bobbin 108 to rotate in a second, opposite direction about the second rotational axis 126. Although the motor arrangement 110 may be variously configured to implement its functionality, in the depicted embodiment the motor arrangement 110 is implemented using two motors—a first motor 132 and a second motor 134. With this implementation, the first motor 132 is coupled to the first hemispherical bobbin 106 via a first shaft 136, and the second hemispherical bobbin 108 is coupled to the second motor 134 via a second shaft 138. It will be appreciated that in other embodiments, the motor arrangement 110 could be implemented using a single motor and a gearing arrangement.

The apparatus 100 may include additional components to those just described. For example, in the depicted embodiment the apparatus further includes an image sensor 142. The image sensor 142, when included, is mounted on the frame 102 and is spaced apart from the first and second hemispherical bobbins 106, 108. Moreover, when the image sensor 142 is included, the first and second hemispherical bobbins 106, 108 each have a slit 144 formed therein (only one visible in FIG. 1). The slits extend through the first and second hemispherical bobbins 106, 108 to allow the image sensor 142 can to capture an image of the first and second wires 112, 114 being wound onto the first and second hemispherical bodies 212, 214 and provide appropriate feedback regarding the winding process. It will be appreciated that the image sensor 142 may be variously implemented using any one of numerous image capture devices, such as any one of numerous types of cameras. It will additionally be appreciated that the first and second hemispherical bodies 212, 214 may be coated with a reflective and a contrasting color, as compared to the color of the first and second wires 112, 114, to further enhance the sensitivity of the image sensor 142.

Figure 4:
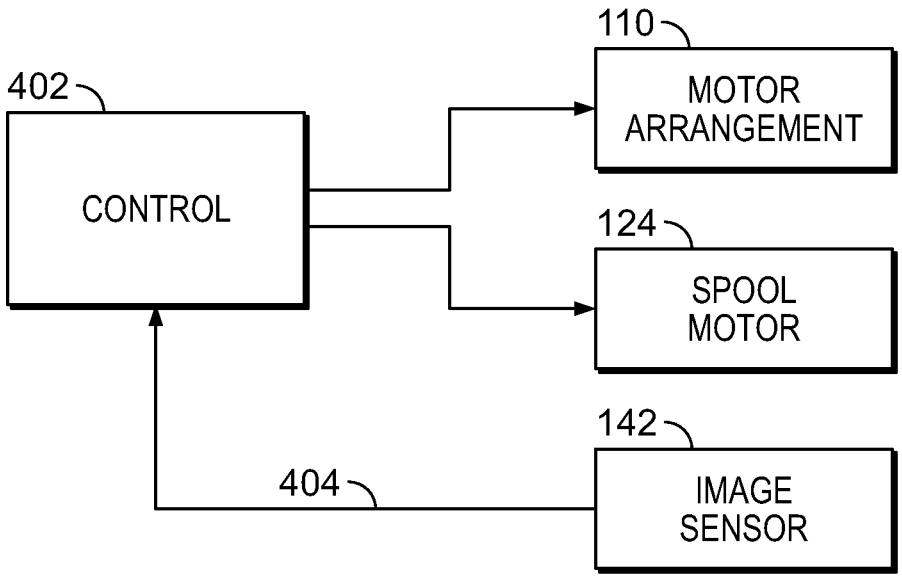
FIG. 4 depicts a functional block diagram of one embodiment of a control system that may be used with the apparatus of FIG. 1.

Referring now to FIG. 4, the feedback from the image sensor 142, when included, may be supplied to a control 402. The control 402 is coupled to receive the feedback signals 404 from the image sensor 142 and is configured, in response thereto, to control the operation of the motor arrangement 110 (e.g., the first and second motors 132, 134) and the operation of the spool motor 124.

Having described the structure and arrangement of one embodiment of the apparatus 100, one example process for winding spherical coils using the apparatus will be described. Initially, one of the first and second supply spools 118, 122 has a known length of wire wound thereon and the other is empty. Half of the wire is unwound from the full spool 118 (122) and is wound onto the empty spool 122 (118). Thus, the first and second supply spools now have the first and second wires 112, 114 wound thereon, and the first and second wires 112, 114 are equal in length. The first and second wires 112, 114 are then wound onto the feeder spool 104.

The ends of the first and second wire 112, 114 are connected to the first and second hemispherical bodies 202, 204, respectively. The first and second hemispherical bodies 202, 204 are then mounted within the first and second hemispherical bobbins 106, 108, respectively, and the first and second spring-loaded pins 302, 304 are placed in compression and engage the first and second wires 112, 114, respectively. Thus, the first and second wires 112, 114 extend through the wire-feeder gap 128 between the feeder spool 104 and the first and second hemispherical bodies 202, 204.

The control 402 then energizes the motor arrangement 110 such that the first hemispherical bobbin 106 and the first hemispherical body 202 rotate around the second rotational axis 126 in a first direction, and such that the second hemispherical bobbin 108 and the second hemispherical body 204 rotate around the first rotational axis 126 in a second direction. Thus, as the first and second wires 112, 114 are wound onto the first and second hemispherical bodies 202, 204, the first and second spring-loaded pins 302, 304 ensure the wires 112, 114 are wound sequentially and tightly onto the first and second hemispherical bodies 202, 204. With each revolution of the first and second hemispherical bobbins 106, 108, the control 402 receives the feedback signals 404 from the image sensor 142, and controls the motor arrangement 110 and/or the spool motor 124, as needed, to control the speed of the winding process.

In this document, relational terms such as first and second, and the like may be used solely to distinguish one entity or action from another entity or action without necessarily requiring or implying any actual such relationship or order between such entities or actions. Numerical ordinals such as "first," "second," "third," etc. simply denote different singles of a plurality and do not imply any order or sequence unless specifically defined by the claim language. The sequence of the text in any of the claims does not imply that process steps must be performed in a temporal or logical order according to such sequence unless it is specifically defined by the language of the claim. The process steps may be interchanged in any order without departing from the scope of the invention as long as such an interchange does not contradict the claim language and is not logically nonsensical.

Furthermore, depending on the context, words such as "connect" or "coupled to" used in describing a relationship between different elements do not imply that a direct physical connection must be made between these elements. For example, two elements may be connected to each other physically, electronically, logically, or in any other manner, through one or more additional elements.

While at least one exemplary embodiment has been presented in the foregoing detailed description of the invention, it should be appreciated that a vast number of variations exist. It should also be appreciated that the exemplary embodiment or exemplary embodiments are only examples, and are not intended to limit the scope, applicability, or configuration of the invention in any way. Rather, the foregoing detailed description will provide those skilled in the art with a convenient road map for implementing an exemplary embodiment of the invention. It being understood that various changes may be made in the function and arrangement of elements described in an exemplary embodiment without departing from the scope of the invention as set forth in the appended claims.

What is claimed is:

1. An apparatus for winding spherical coils, comprising:
a frame;
a feeder spool rotationally mounted on the frame and configured to rotate about a first rotational axis, the feeder spool having a first wire wound thereon and a second wire wound thereon;
a first hemispherical bobbin rotationally mounted on the frame, the first hemispherical bobbin having a first inner surface and configured to rotate about a second rotational axis that is parallel to the first rotational axis;
a second hemispherical bobbin rotationally mounted on the frame, the second hemispherical bobbin having a second inner surface and configured to rotate about the second rotational axis, the second hemispherical bobbin spaced apart from the first hemispherical bobbin to define a wire-feeder gap through which the first and second wires may be fed;
a first spring-loaded pin mounted on the first inner surface;
a second spring-loaded pin mounted on the second inner surface; and
a motor arrangement coupled to the first and second hemispherical bobbins, the motor arrangement configured to cause the first hemispherical bobbin to rotate in a first rotational direction about the second rotational axis, and cause the second hemispherical bobbin to rotate in a second rotational direction about the second rotational axis, the second rotational direction opposite to the first rotational direction.

2. The apparatus of claim 1, further comprising:
a spool motor coupled to the feeder spool, the spool motor operable to regulate a rate at which the first and second wires are being supplied.

3. The apparatus of claim 1, further comprising:
a first supply spool spaced apart from the feeder spool and rotationally mounted on the frame, the first supply spool having a portion of the first wire wound thereon; and
a second supply spool spaced apart from the feeder spool and rotationally mounted on the frame, the second supply spool having a portion of the second wire wound thereon.

4. The apparatus of claim 3, wherein the first supply spool and the second supply spool are each configured to rotate about the first rotational axis.

5. The apparatus of claim 1, wherein the first and second inner surfaces define first and second hemispherical cavities, respectively, and wherein the apparatus further comprises:
a first hemispherical body disposed within the first hemispherical cavity and adapted to have the first wire wound thereon; and
a second hemispherical body disposed within the second hemispherical cavity and adapted to have the second wire wound thereon.

6. The apparatus of claim 5, wherein the first and second hemispherical bodies are each coated with a reflective coating.

7. The apparatus of claim 1, wherein:
the first spring-loaded pin comprises:
a first spring guide coupled to the first inner surface;
a first spring disposed around the first spring guide; and
a first pin coupled to and extending from the first spring; and
the second spring-loaded pin comprises:
a second spring guide coupled to the second inner surface;
a second spring disposed around the second spring guide; and
a second pin coupled to, and extending from, the second spring.

8. The apparatus of claim 7, further comprising:
a first guide slot formed in the first hemispherical bobbin, the first pin extending at least partially into the first guide slot; and
a second guide slot formed in the second hemispherical bobbin, the second pin extending at least partially into the second guide slot.

9. The apparatus of claim 1, wherein the motor arrangement comprises:
a first motor coupled to the first hemispherical bobbin;
a second motor coupled to the second hemispherical bobbin.

10. The apparatus of claim 9, further comprising:
a first shaft coupled between the first motor and the first hemispherical bobbin; and
a second shaft coupled between the second motor and the second hemispherical bobbin.

11. The apparatus of claim 1, further comprising:
an image sensor mounted on the frame and spaced apart from the first and second hemispherical bobbins.

12. The apparatus of claim 11, further comprising:
a first slit formed in, and extending through, the first hemispherical bobbin; and
a second slit formed in, and extending through, the second hemispherical bobbin,
wherein the image sensor is disposed to capture images through the first and second slits.

13. An apparatus for winding spherical coils, comprising:
a frame;
a feeder spool rotationally mounted on the frame and configured to rotate about a first rotational axis, the feeder spool having a first wire wound thereon and a second wire wound thereon;
a first hemispherical bobbin rotationally mounted on the frame, the first hemispherical bobbin having a first inner surface and configured to rotate about a second rotational axis that is parallel to the first rotational axis;
a second hemispherical bobbin rotationally mounted on the frame, the second hemispherical bobbin having a second inner surface and configured to rotate about the second rotational axis, the second hemispherical bobbin spaced apart from the first hemispherical bobbin to define a wire-feeder gap through which the first and second wires may be fed;
a first slit formed in, and extending through, the first hemispherical bobbin;
a second slit formed in, and extending through, the second hemispherical bobbin;
a first spring-loaded pin mounted on the first inner surface;
a second spring-loaded pin mounted on the second inner surface;
a spool motor coupled to the feeder spool, the spool motor operable to regulate a rate at which the first and second wires are being supplied;
a motor arrangement coupled to the first and second hemispherical bobbins, the motor arrangement configured to cause the first hemispherical bobbin to rotate in a first rotational direction about the second rotational axis, and cause the second hemispherical bobbin to rotate in a second rotational direction about the second rotational axis, the second rotational direction opposite to the first rotational direction;
an image sensor mounted on the frame and spaced apart from the first and second hemispherical bobbins, the image sensor disposed to capture images through the first and second slits and supply feedback signals; and a control in operable communication with the image sensor, the spool motor, and the motor arrangement, the control coupled to receive the feedback signals from the image sensor and configured, in response thereto, to control the spool motor and motor arrangement.

14. The apparatus of claim 13, further comprising:

a first supply spool spaced apart from the feeder spool and rotationally mounted on the frame, the first supply spool having a portion of the first wire wound thereon; and a second supply spool spaced apart from the feeder spool and rotationally mounted on the frame, the second supply spool having a portion of the second wire wound thereon, wherein the first supply spool and the second supply spool are each configured to rotate about the first rotational axis.

15. The apparatus of claim 13, wherein the first and second inner surfaces define first and second hemispherical cavities, respectively, and wherein the apparatus further comprises:

a first hemispherical body disposed within the first hemispherical cavity and adapted to have the first wire wound thereon; and a second hemispherical body disposed within the second hemispherical cavity and adapted to have the second wire wound thereon.

16. The apparatus of claim 15, wherein the first and second hemispherical bodies are each coated with a reflective coating.

17. The apparatus of claim 13, wherein:

the first spring-loaded pin comprises:

a first spring guide coupled to the first inner surface;

a first spring disposed around the first spring guide; and a first pin coupled to and extending from the first spring;

the second spring-loaded pin comprises:

a second spring guide coupled to the second inner surface;

a second spring disposed around the second spring guide; and a second pin coupled to, and extending from, the second spring; and the apparatus further comprises:

a first guide slot formed in the first hemispherical bobbin, the first pin extending at least partially into the first guide slot; and a second guide slot formed in the second hemispherical bobbin, the second pin extending at least partially into the second guide slot.

18. The apparatus of claim 13, wherein the motor arrangement comprises:

a first motor coupled to the first hemispherical bobbin;

a second motor coupled to the second hemispherical bobbin.

19. The apparatus of claim 18, further comprising:

a first shaft coupled between the first motor and the first hemispherical bobbin; and a second shaft coupled between the second motor and the second hemispherical bobbin.

20. An apparatus for winding spherical coils, comprising:

a frame;

a feeder spool rotationally mounted on the frame and configured to rotate about a first rotational axis, the feeder spool having a first wire wound thereon and a second wire wound thereon;

a first hemispherical bobbin rotationally mounted on the frame, the first hemispherical bobbin having a first inner surface and configured to rotate about a second rotational axis that is parallel to the first rotational axis, the first inner surface defining a first hemispherical cavity;

a second hemispherical bobbin rotationally mounted on the frame, the second hemispherical bobbin having a second inner surface and configured to rotate about the second rotational axis, the second hemispherical bobbin spaced apart from the first hemispherical bobbin to define a wire-feeder gap through which the first and second wires may be fed, the second inner surface defining a second hemispherical cavity;

a first hemispherical body disposed within the first hemispherical cavity and adapted to have the first wire wound thereon;

a second hemispherical body disposed within the second hemispherical cavity and adapted to have the second wire wound thereon;

a first slit formed in, and extending through, the first hemispherical bobbin;

a second slit formed in, and extending through, the second hemispherical bobbin;

a first spring-loaded pin mounted on the first inner surface;

a second spring-loaded pin mounted on the second inner surface;

a spool motor coupled to the feeder spool, the spool motor operable to regulate a rate at which the first and second wires are being supplied;

a motor arrangement coupled to the first and second hemispherical bobbins, the motor arrangement configured to cause the first hemispherical bobbin to rotate in a first rotational direction about the second rotational axis, and cause the second hemispherical bobbin to rotate in a second rotational direction about the second rotational axis, the second rotational direction opposite to the first rotational direction;

an image sensor mounted on the frame and spaced apart from the first and second hemispherical bobbins, the image sensor disposed to capture images through the first and second slits and supply feedback signals; and a control in operable communication with the image sensor, the spool motor, and the motor arrangement, the control coupled to receive the feedback signals from the image sensor and configured, in response thereto, to control the spool motor and motor arrangement.

* * * * *